United States Patent [19]

Brusadin

[11] Patent Number: 4,813,606

[45] Date of Patent: Mar. 21, 1989

[54] PULSATING SPRAYER

[75] Inventor: Giacomo Brusadin, Pordenone, Italy

[73] Assignee: Uniflex Utiltime S.p.A., Montereale Valcellina, Italy

[21] Appl. No.: 886,963

[22] Filed: Jul. 18, 1986

[30] Foreign Application Priority Data

Jul. 24, 1985 [IT] Italy ..... 45728 A/85

[51] Int. Cl.[4] ..... B05B 3/14; B05B 1/26

[52] U.S. Cl. ..... 239/230; 239/231; 239/507; 239/515

[58] Field of Search ..... 239/231–233, 239/206, 230, 505, 507, 512, 513, 515, 509

[56] References Cited

U.S. PATENT DOCUMENTS

| | | | |
|---|---|---|---|
| 2,778,677 | 1/1957 | Gould et al. | 239/513 |
| 3,009,650 | 11/1961 | Alvarez | 239/233 X |
| 3,070,314 | 12/1962 | Warren | 239/253 X |
| 3,434,664 | 3/1969 | Friedmann et al. | 239/206 |
| 3,765,608 | 10/1973 | Lookwood | 239/231 X |
| 3,918,643 | 11/1975 | Malcolm | 239/233 X |
| 3,977,610 | 8/1976 | Royer | 239/233 X |
| 4,205,788 | 6/1980 | Bruninga | 239/233 |
| 4,565,323 | 1/1986 | Berkan | 239/233 X |

FOREIGN PATENT DOCUMENTS

| | | | |
|---|---|---|---|
| 596864 | 11/1925 | France | 239/512 |

*Primary Examiner*—Andres Kashnikow
*Assistant Examiner*—Kevin P. Weldon
*Attorney, Agent, or Firm*—Wenderoth, Lind & Ponack

[57] ABSTRACT

An oscillating sprayer for spraying water on surrounding areas including a cylindrical main body and a support for rotatably supporting a lower part of the main body. An inclined nozzle extends radially outwardly and upwardly from the main body and an adjustable water stream deflector is disposed on the main body for adjusting the height of a water stream ejected from the nozzle by intercepting the water stream at a plurality of points spaced from the main body. An oscillating arm is rotatably supported on an upper part of the main body, the oscillating arm including water impact deflectors at one end thereof for causing rotation of the oscillating arm in a first direction away from the water stream by intercepting the water stream, the oscillating arm being engageable with the water stream deflector when the oscillating arm is rotated in a second direction towards the water stream to thereby cause step-by-step rotation of the main body in the second direction due to impact of the oscillating arm with the water stream deflector. A removable pivot is disposed on an upper end of the main body for pivoting the oscillating arm about a vertical axis and a spring is disposed between the pivot and the oscillating arm for biasing the oscillating arm in the second direction towards the water stream. A reversing mechanism is provided for reversing the step-by-step rotation of the main body from the first direction to the second direction.

11 Claims, 7 Drawing Sheets

PULSATING SPRAYER

BACKGROUND OF THE INVENTION

1. Field of the Invention

The present invention relates to a sprayer, which may particularly be employed for gardening pusposes and more exactly concerns a pulsating sprayer utilizing an oscillating mechanism, which is driven by the water jet coming out from a nozzle for obtaining a variable sprinkling range in an intermittent manner and at the same time a step-by-step rotation of the whole sprayer with respect to its support, which rotation may be alternately reversed in a manner which may be predetermined by means of a suitable device, in order to obtain the spraying of variable circular areas.

2. Description of the Prior Art

Sprayers of this kind are already known, which are constituted substantially by a main hollow body vertically fixable on an adequate support for the connection to a water supply line, which connection is effected by means of an adequate fixing element, the main hollow body being able to rotate freely with respect to the fixing element and being provided with a nozzle radially disposed near its upper end portion, which nozzle is adequately inclined upwardly, as well as an oscillating arm which is coaxially pivoted on the upper end portion of the main hollow body and maintained in a position borne against a stopping element provided on the main body, by means of a helicoidal spring which is interposed between the oscillating arm and the main body, wherein the oscillating arm is provided with baffles which generate a thrust under the water jet action, causing the oscillating arm to be rotated in a direction which is opposite to that of the spring action, which oscillating arm is moved until the baffles are no longer submitted to the water jet action.

In this manner, the oscillating arm is returned by the spring action to bear against the stopping element, thus generating an impulse able to produce a small rotary movement of the whole main body in the direction of the impact and permitting a new operation cycle to be started, which cycle is indefinitely repeated and produces an intermittent rotary movement.

SUMMARY OF THE INVENTION

It is an object of the present invention to provide a device which reverses the rotary movement, which device is constituted by a snap acting kinematic motion device, which is able to bring a stopping tooth in correspondence with the path of the oscillating arm or to remove the stopping tooth therefrom, wherein the snap acting kinematic motion device is operated by a lever, an end portion of which is actuated by two stop elements which may be circumferentially disposed in different positions on the main body.

In this manner, when the stopping tooth is brought by the kinematic motion device in correspondence with the path of the oscillating arm, the impact of the latter against the stopping tooth produces an intermittent rotary motion thereof in the direction of the impact, which motion continues in the same direction until the lever which operates the snap acting kinematic motion device comes into contact with a first stop element, so causing the stopping tooth to be removed from the path of the oscillating arm and therefore producing the reversal of the intermittent rotary movement. The conventional sprayers generally present different constructive and functional inconveniences which are overcome by the sprayer of the present invention.

First, the conventional sprayers are generally constituted by many components, which often may be assembled together in a difficult manner; in addition, they comprise complicated regulating devices which often are operated in a difficult manner and cause these sprayers to operate inconsistently especially when parameters such as the water supply pressure change. Finally, these sprayers are often unreliable. An object of the present invention is to eliminate the above inconveniences and limitations by producing a pulsating sprayer, which is characterized by an improved system for the anchorage of the helicoidal spring situated between the sprayer body and the oscillating arm, in which system the end portions of the helicoidal spring for returning the oscillating arm are radially folded to form a short portion, wherein the folded short portions are engaged against respective parts, one of which is provided on the body on which the oscillating arm is pivoted and the other one of which is provided on the corresponding rotation pivot, wherein the rotation pivot can be inserted and fixed, after it has been adequately positioned to prestress the spring, into a relative hole coaxially provided in the upper end portion of the main body. Thus, the present invention provides a system which permits the assembling operation to be simplified and at the same time allows an accurate pre-loading of the spring, which ensures a regular and uniform operation of the sprayer.

Other objects of the present invention include the provision of an adjustable jet deflector constituted by a flat element which is radially slidable along a horizontal plane on a support, the deflector projecting radially from the sprayer body so as to intercept the water jet in a variable manner in order to reduce progressively its height. A reversing device is provided to invert the rotation direction of the sprayer, which device may be operated by two adjustable stop elements for determining the amplitude of the water spraying angle, and which permits the extension of the rotational movement of the sprayer through an angle of 360°, in a manner in which the complete rotation thereof in two opposed directions permits a more uniform and regular distribution of the water which is sprayed. An element of the reversing device is provided for inverting the direction of rotation of the sprayer, which element is made of plastic material and so shaped as to form a resilient part integral therewith, which part is capable of replacing the normally utilized metallic spring thereby permitting a single element to exploit the functions of two distinct elements made of different materials as well as to simplify the assembling operation. Finally, a screw is provided for diffusion of the water jet, which screw is provided with means for preventing its extraction from a support in which the screw is held.

BRIEF DESCRIPTION OF THE DRAWINGS

The present invention will be described with reference to the following detailed description of the preferred embodiments and attached drawings, in which.

DETAILED DESCRIPTION OF THE PREFERRED EMBODIMENTS

Figure 1:
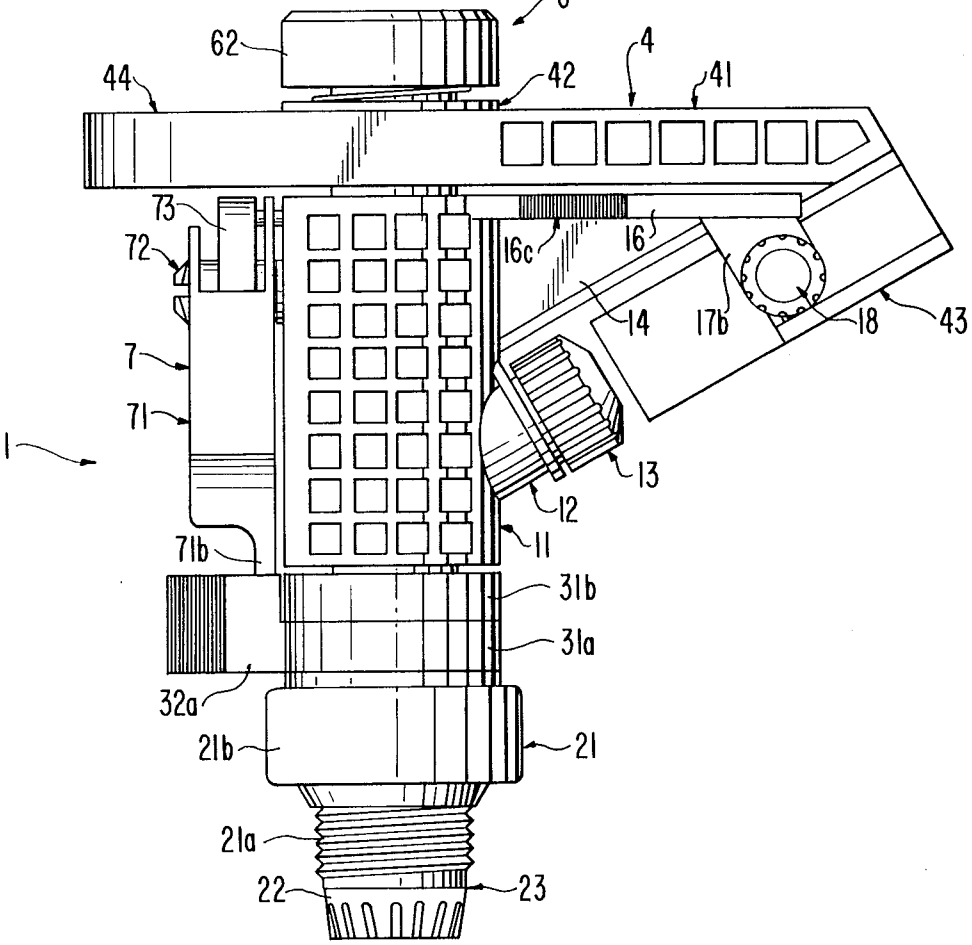
FIG. 1 shows a side view of the pulsating sprayer according to the present invention.
Figure 2:
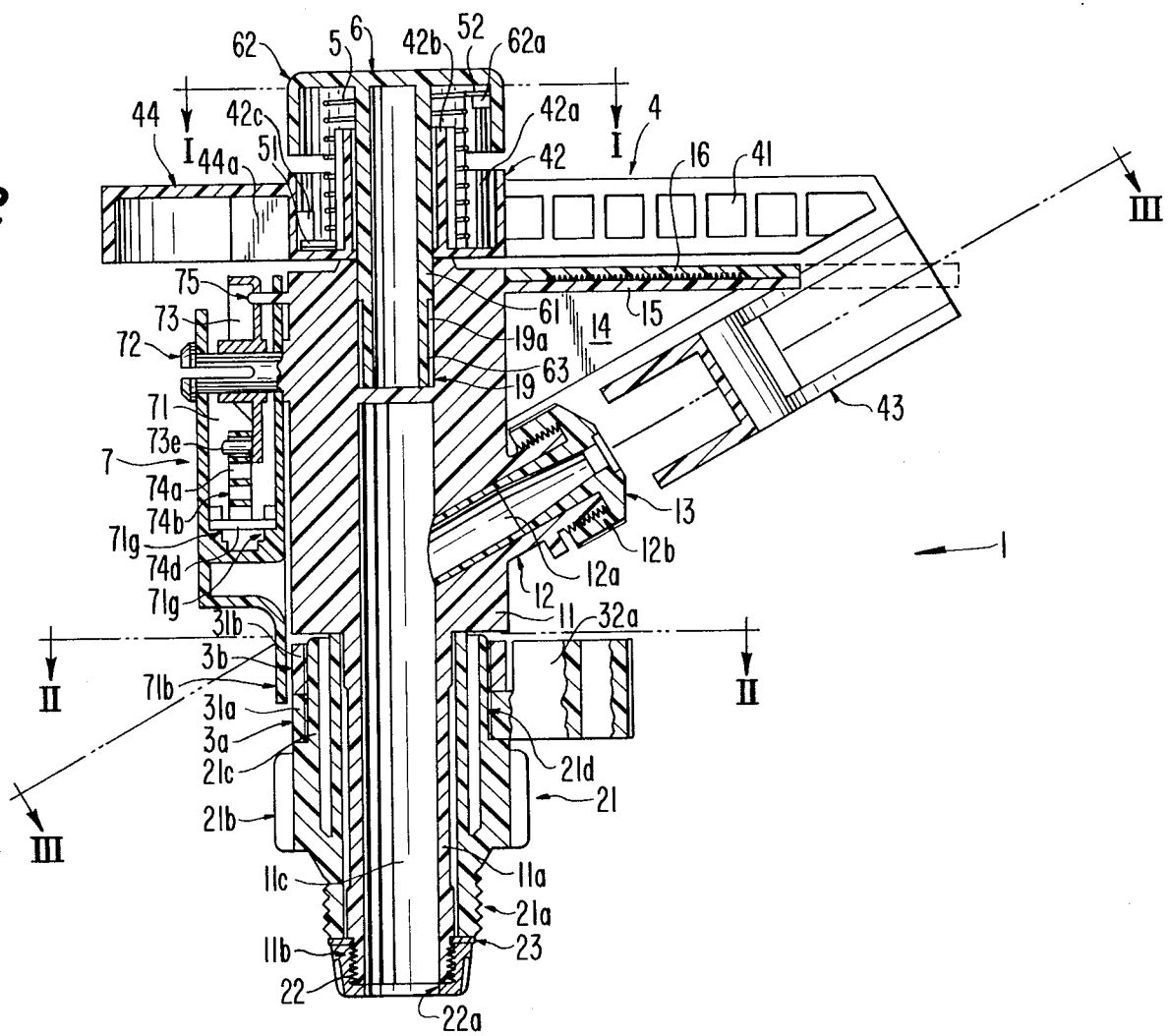
FIG. 2 shows a sectional view of the sprayer shown in FIG. 1 taken from the same side as shown in FIG. 1.
Figure 3:
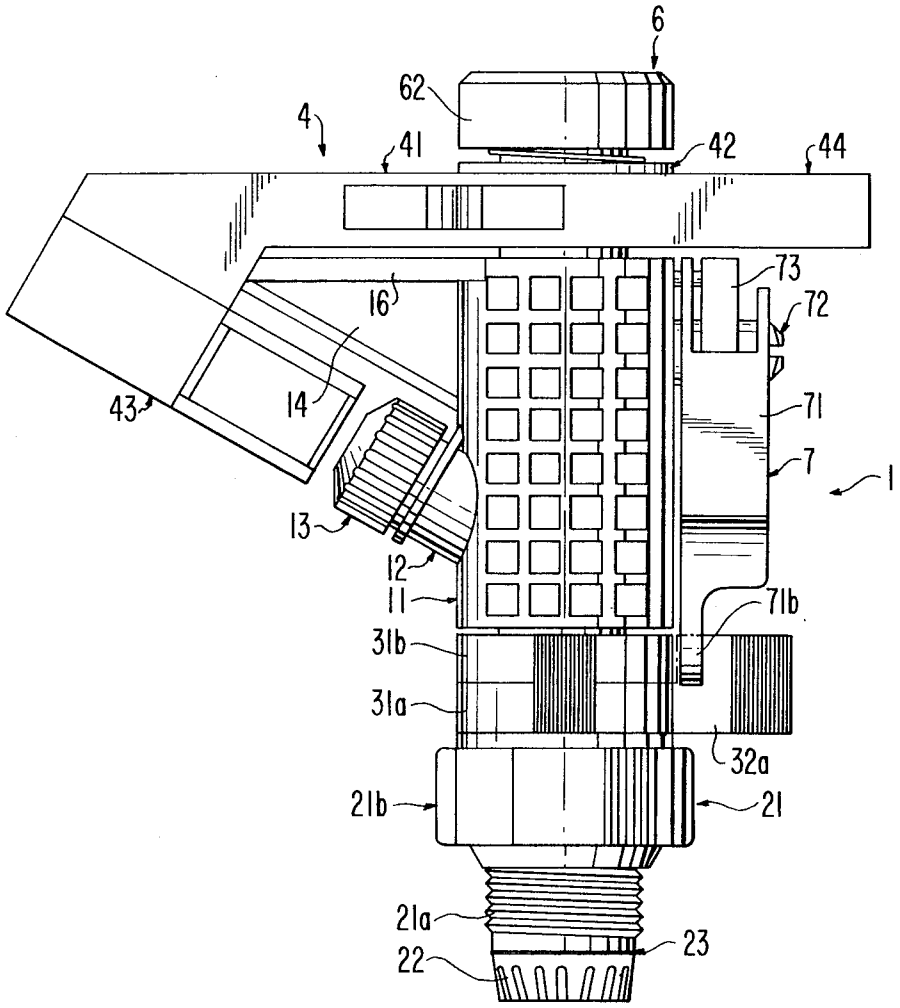
FIG. 3 shows a side view of the sprayer shown in FIG. 1 taken from the opposite side with respect to that of FIG. 1.

In the above mentioned figures, identical parts are referred to with the same numerical references. Referring now to these figures and more particularly to FIGS. 1, 2 and 3, showing the sprayer indicated with the numerical reference 1, it is to be noted that such a pulsating sprayer is constituted by a main body 11 basically formed by a hollow cylindrical element, which terminates in its lower part with a tubular portion 11*a*, on which a ring nut 21 is applied, which ring nut acts for the connection to a suitable support from which the sprayer is fed with water and in which the main body 11 may freely rotate with respect to the support. The ring nut 21 comprises in its lower part a threaded portion 21*a* permitting the ring nut to be connected onto the support, then comprises a hexagonal element 21*b* disposed upon the threaded portion 21*a* and shaped as a nut for permitting the ring nut to be rotated. Finally, the ring nut 21 terminates in its upper part with a cylindrical portion 21*c* provided with a plurality of notches 21*d* around its entire outer surface, which notches extend longitudinally and have a function which will be set forth hereinafter.

The ring nut 21 is fixed in its lower part onto the tubular portion 11*a* by means of an internally threaded annular element 22, which engages itself in a corresponding threaded portion 11*b* provided on the end portion of the tubular portion 11*a*, a washer 23 of a suitable antifriction material being interposed between the ring nut 21 and the annular element 22.

When the annular element 22 is screwed on the main body 11, a radially inwardly extending collar 22*a* of the annular element 22 bears against the lower free end of the tubular portion 11*a*, in a manner in which the ring nut 21 is not tightened between the annular element 22 and the main body 11, thereby permitting the sprayer to rotate freely with respect to the support on which it is fixed.

Figure 12:
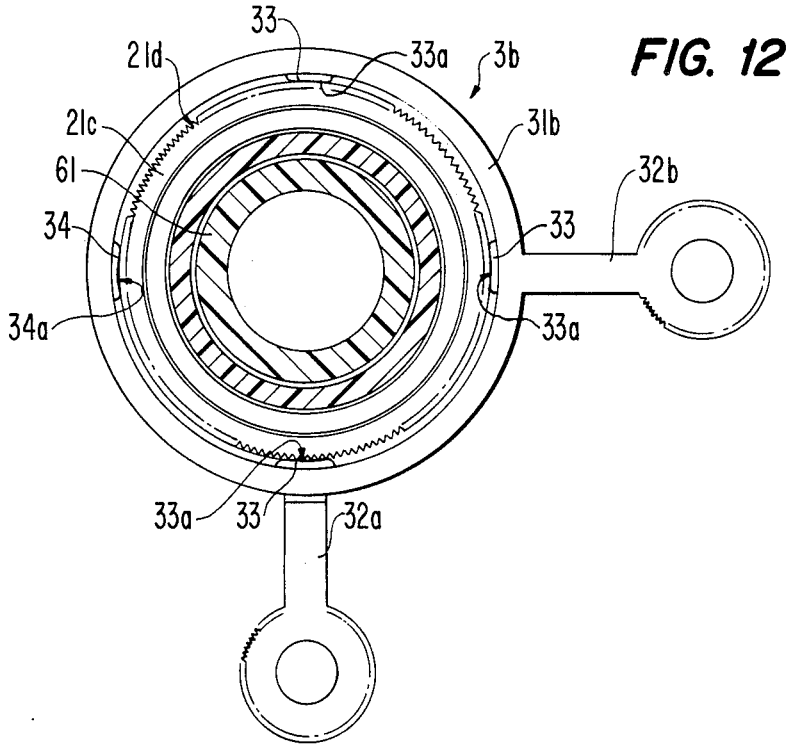
FIG. 12 shows, in a sectional view along the line II—II of FIG. 2, the configuration of the elements which limit the degree of rotation of the sprayer.

Two identical stop elements 3*a*, 3*b*, whose specific configuration is clearly illustrated in FIG. 12, are disposed around the cylindrical portion 21*c*.

Referring now to FIG. 12, it is to be noted that each of the stop elements (3*a*–3*b*) is constituted by a cylindrical ring 31, internally provided with four projecting parts equally spaced with respect to each other, wherein three of the projecting parts and specifically the projections 33 are protruding from the inner surface of the cylindrical ring 31, so as to form three sliding surfaces 33*a* which are substantially tangential to the vertices of the notches 21*d*, provided on the cylindrical portion 21*c*, while the fourth part and specifically a projection 34 is similar to the projections 33, however it is provided with longitudinally extending notches 34*a* on its inner surface, which are engageable with the above specified notches 21*d*.

Moreover, a respective tab 32*a*, 32*b* constituted by a rectangular element projects radially outwardly from the corresponding ring 31*a*, 31*b*, which element extends longitudinally a distance equal to the height of both of the rings 31*a*, 31*b*, the lower tab 32*a* having a space between it and the upper ring 31*b* and the upper tab 32*b* having a space between it and the lower ring 31*a* to allow rotation of the rings 31*a*, 31*b* with respect to each other.

In this manner, in the case in which two such stop elements 3*b*, 3*a* are assembled together in an upper and lower position, there is obtained two projecting parts, the tabs 32*a* and 32*b*, which constitute two elements acting as effective stop elements and which are completely equal in effect during operation.

In addition, such tabs 32*a* and 32*b* are capable of being manually operated in order to be displaced with respect to the main body 11.

In fact, it becomes evident that by acting on the tabs 32*a* and/or 32*b* by an adequate tangential push, the respective ring 31*a* and/or 31*b* will be rotated as the notches 34*a* are resiliently disengaged from the corresponding notches 21*d* and that as soon as the push ceases, such notches 34*a* and/or 34*b* will be resiliently engaged again with the notches 21*d*, so establishing the desired positioning. In FIG. 12, the upper stop element 3*b* is particularly illustrated, while the other element 3*a* as already specified is completely equal to it, so that any later description of relevant parts of these stop elements are reciprocally distinguished by adding the literal symbol a or b to their numerical reference.

A hollow cylindrical body 12 extends radially outwardly and upwardly from the main body 11 and an inner cavity 12*a* of the body 12 is in fluid communication with an inner cavity 11*c* of the main body 11. The cylindrical body 12 terminates with a threaded portion 12*b* on which a nozzle 13 is removably engaged.

A longitudinally extending triangular plate extends from the main body at a position above the cylindrical body 12 and an upper part of the plate 14 is connected to a radially extending rectangular plate 15, which is projecting from the upper end portion of the main body 11. A flat element 16 is slidably engaged with and supported on an upper surface of the rectangular plate 15.

Figure 10:
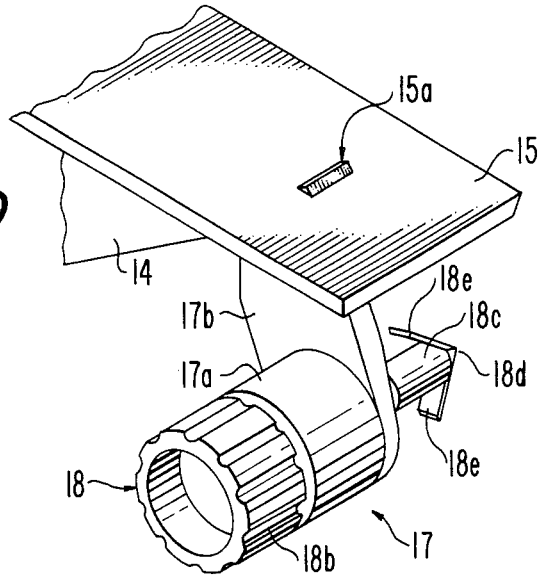
FIGS. 10 and 11 show perspective views, respectively, of the support for the horizontal water jet deflector, together with the water jet diffusion screw and of the deflector element to be applied onto the support.

Referring now to FIG. 10, a support body 17, which is supporting a screw 18 for the water jet diffusion, is laterally projecting downwardly from an end portion of the rectangular plate 15, wherein the support body 17 is constituted by a cylindrical element 17*a* in which the screw 18 is engaged and which is connected to the rectangular plate 15 by means of an arm 17*b* which depends from one side of the plate 15.

Figure 11:
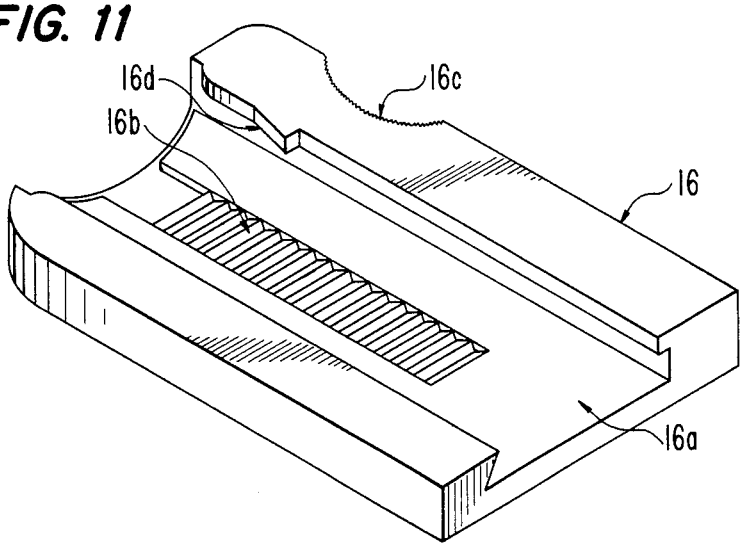

FIGS. 10 and 11 show the details of the flat element 16 together with relative rectangular support plate 15 as well as that of the screw 18 with the relative arrangement thereof onto the rectangular plate 15.

Referring to the FIGS. 10 and 11, it is to be noted that the flat element 16 is provided with a longitudinal groove 16*a* defined by sidewalls in the flat element, one of the sidewalls having a rectangular recess therein and the other sidewall being at an acute angle to the bottom of the groove 16*a*, the rectangular plate 15 being received in the groove 16*a* to obtain a reciprocal sliding joint therebetween.

In addition, on the bottom of the longitudinal groove 16*a* there is provided a series of teeth in a longitudinal notched portion 16*b*, the teeth engageable with a tooth 15*a* provided on the upper surface of the rectangular plate 15.

Figure 8:
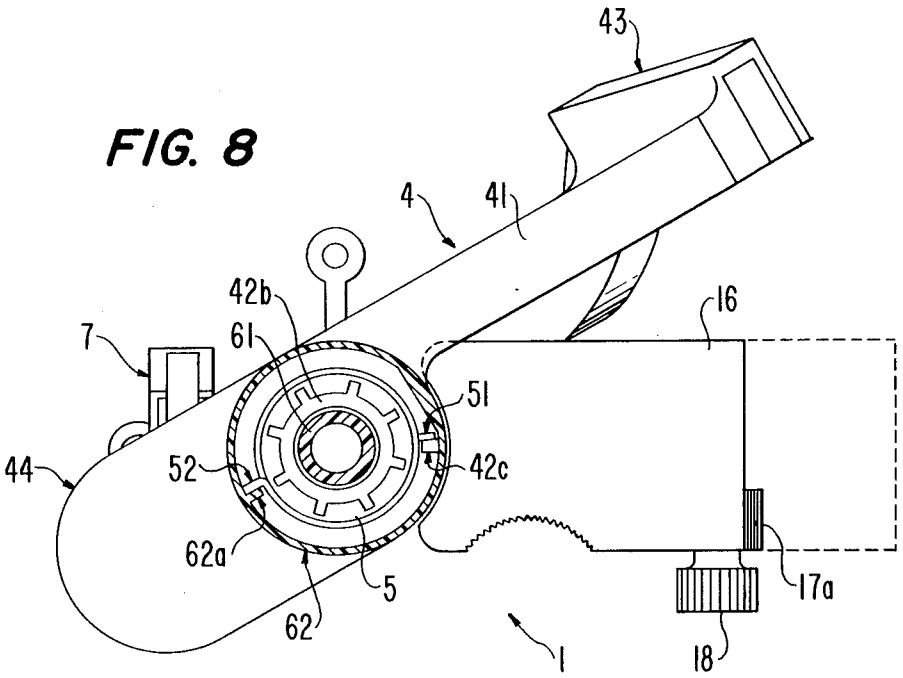
FIG. 8 is a top view, partially cut along the line I—I of FIG. 2, in which the oscillating arm is however shifted for permitting the configuration of the flat element to be shown, which element constitutes the deflector of the height of the water jet. This view also illustrates, in its cutaway portion, the arrangement of the helicoidal spring interposed between the oscillating arm and the sprayer body.

It follows that the flat element 16 may be easily shifted longitudinally along the rectangular plate 15, so that it may be shifted from the completely retracted position illustrated with solid lines in FIGS. 1, 2, 3 and 8, in which the flat element 16 does not intercept the water jet, to the maximum extended position clearly illustrated with dotted lines in FIGS. 2 and 8, in which it completely intercepts the water jet to cause its maximum deflection.

The flat element 16 may be spring locked against the rectangular plate 15 by the interaction of the tooth 15*a* and the corresponding teeth of the notched portion 16*b*. Finally, on a lateral outside edge of the flat element 16 there is a cavity 16*c* for facilitating actuation of the flat element 16, and a tooth 16*d* is also provided on one lateral sidewall of the longitudinal groove 16*a*, which sidewall corresponds to the side of the rectangular plate 15 on which the arm 17*b* depends, wherein the tooth 16*d* will be engaged against the arm 17*b* to prevent the flat element 16 from sliding off the plate 15, when the flat element 16 is pushed toward the outer side, in its maximum extended position.

Figure 9:
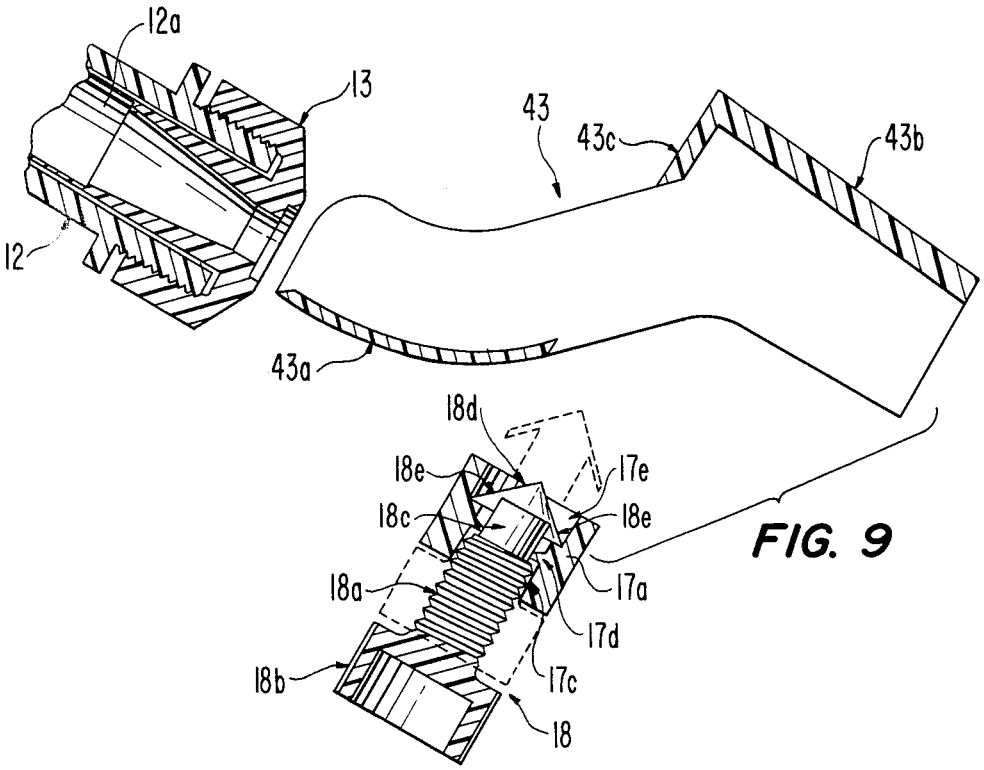
FIG. 9 is a partial sectional view along the line III—III of FIG. 2, showing the configuration of the water jet deflecting surfaces, which are situated at the free end portion of the oscillating arm and the water jet diffusion screw.

As shown in FIG. 9, the screw 18 is provided with a simple and helpful system for preventing the unthreading thereof. To this aim, as can be seen from FIGS. 9 and 10, the screw 18 is constituted by a threaded shank 18*a* having at one end portion thereof a head 18*b* for rotation thereof and a cylindrical portion 18*c* at the other end portion thereof, which cylindrical portion 18*c* has a diameter which is somewhat smaller than the inner diameter of the threading on the shank 18*a*. The cylindrical portion 18*c* also terminates with a conical portion 18*d*, from the base of which two short inclined fins 18*e* project therefrom, whose angle of inclination is equal to the generatrix of the conical portion 18*d*.

A cylindrical element 17*a*, in which the screw 18 is engaged, is also adequately shaped for this purpose. The through hole of the cylindrical element 17*a*, in which the screw 18 engages itself, includes a short cylindrical portion 17*c* at one end thereof, in which the screw 18 may freely translate, an intermediate short threaded portion 17*d* and an additional cylindrical portion 17*e* at the other end thereof, the portion 17*e* having a diameter which is at least equal to the distance between the free end portions of the inclined fins 18*e*.

With this arrangement, the screw 18 may be inserted into the support body 17 by pushing it into the through hole of the cylindrical element 17*a*, whereupon the inclined fins 18e are inwardly bent as they pass along the threaded portion 17*d* having the minimum passage diameter, and are again resiliently returned back outwardly, as soon as they have passed the threaded portion 17*d*. Then, the screw 18 can be advanced until its conical portion 18*d* intercepts the water jet (shown with a dotted line in FIGS. 9), so as to obtain the adjustable deflection effect of the water jet.

The screw 18 may be unscrewed until the threaded portion 18*a* of the screw has been completely disengaged from the threaded portion 17*d* of the cylindrical element 17*a*. However, in this case, the inclined fins 18*e* engage against the bottom side of the cylindrical portion 17e, thereby preventing the screw 18 from being unthreaded from the cylindrical element 17*a*.

In addition, onto the upper side of the main body 11, an oscillating arm 4 is pivoted, the arm 4 comprising a rigid rod 41 having one end portion which terminates with a cylindrical pivoting portion 42 and the other end portion which is provided with a deflection unit 43 of a conventional type for the water jet deflection.

The cylindrical pivoting portion 42 includes an auxiliary arm 44 extending therefrom, in a position which is diametrically opposite to the rigid rod 41. The arm 44 is adequately shaped and provided at its inner side with an impact element 44*a*, capable of stopping the movement of the oscillating arm 4 when, during its movement, it bears against a stopping tooth 73 of a device 7 which inverts the rotating movement of the sprayer, as will be hereinafter described.

The water jet deflection unit 43 is clearly illustrated in FIG. 9 and comprises a first deflecting fin 43*a*, which deflects the water jet laterally toward a second deflecting fin 43*b* which is arranged nearly parallel to the water jet axis and is provided in its back side with a wall 43*c*, for preventing or at least minimizing the water spray in any unexpected direction (in the inner and lateral direction). The second fin 43*b* is disposed outwardly and slightly convergent with respect to the axis of the water jet produced by the nozzle 13, in order to obtain the jet coming out therefrom substantially parallel to the water jet axis.

The cylindrical pivoting portion 42 is constituted by a hollow cylindrical element 42*a* having an outer cylindrical wall and a bottom wall and an annular cylindrical body 42*b* projecting upwardly from the bottom wall of the element 42*a*, the body 42*b* constituting the actual pivoting bushing. The element 42*a* also includes a fin 42*c*, which extends radially inwardly from the outer cylindrical wall, the fin 42*c* constituting, as will be hereinafter described, a first element in which a return spring 5 of the oscillating arm 4 is engaged.

Finally, the pivoting of the oscillating arm 4 is obtained by means of a pivot 6 formed by a tubular body 61, constituting the actual pivot element which is introduced into the bushing 42*b*, and is fixed into a hole 19 provided in the center of an upper end of the main body 11, in a coaxial relationship with respect thereto. The tubular body 61 terminates at an upper end portion thereof with a hollow cylindrical element 62, having a top wall and a circumferential sidewall depending therefrom. A fin 62*a* extends radially inwardly from the circumferential sidewall, the fin 62*a* constituting a second element for engaging the spring 5. The tubular body 61 terminates at a lower end portion thereof with a part in which slightly longitudinal grooves 63 are provided for engaging corresponding slightly longitudinal ribs 19*a* formed on a lower inner portion of the hole 19.

The helical spring 5 is interposed between the hollow cylindrical elements 42*a* and 62, the spring 5 having end portions which are bent radially outwardly to form a short lower radial portion 51 and a short upper radial portion 52, which are engageable, respectively, against the fins 42*c* and 62*a*, thereby permitting the following advantages to be obtained.

The above described arrangement permits the oscillating arm 4 to be assembled in the following manner. As the helical spring 5 is inserted into the hollow cylindrical element 42, the tubular body 61 is inserted into the annular cylindrical body 42*b*, in a manner in which the helical spring 5 will be held between the hollow cylindrical elements 42*a* and 62. Then, the lower portion of the tubular body 61 is inserted into the hole 19 of the main body 11 until it comes near the zone provided with the longitudinal ribs 19*a*. At this moment, the pivot 6 is rotated in a direction which causes the rigid rod 41 and the flat element 16 to be aligned with one another, so that the fins 42*c* and 62*a* will engage against the respective radial portions 51 and 52 of the spring 5 and after that produce a progressive loading thereof, by causing further rotational movement of the pivot 6.

By appropriately positioning the rigid rod 41 against a suitable dynamometrical device, it is possible to give a preestablished pre-loading to the spring 5 and then, as soon as the required pre-load value has been attained, the rotational movement of the pivot 6 is stopped and the pivot 6 is definitively pushed toward the main body 11, to obtain the total insertion of the tubular body 61 into the hole 19 and cause the reciprocal introduction of the longitudinal ribs 19*a* into the longitudinal grooves 63, which provide an adequate mutual locking engagement and determine in this way the final locking of the two parts. From what has been described, it should be evident that the specific arrangement described for the application of the return spring 5 to the arm 4 permits a very simple and rapid assembling thereof and at the same time allows a controllable pre-loading of the spring 5, a feature which permits during the manufacturing steps, the obtainment of a steady pre-loading and therefore also a regular performance of the device.

The device is completed by a reversing device for reversing the rotational movement thereof, which is generally designated by the reference numerical 7 and illustrated both in its constructive parts and operation specifically in FIGS. 4, 5, 6 and 7.

Referring now to FIGS. 1, 2 and 3 in addition to FIGS. 4, 5, 6 and 7, it is to be noted that such device 7 is constituted by an actuating lever 71, which is pivoted at an upper end thereof to a pivot pin 72, which extends radially from the main body 11 on a side thereof which is diametrically opposite to that from which the water is dispensed. The stopping tooth 73 for the oscillating arm 4 is also pivoted on the pivot pin 72 at a central position thereof such that the tooth 73 is disposed between spaced apart longitudinally extending walls of the lever 71. A resilient connecting rod 74 is interposed between a lower portion of the actuating lever 71 and one end of the stopping tooth 73.

The actuating lever 71 includes an upper arm 71*c*, a lower arm 71*a* and an operating finger 71*b* depending from a lower end of the lower arm 71*a*, the finger 71*b* projecting downwardly into a zone in which the stop elements 3*a* and 3*b* are provided. The upper arm 71*c* has a cavity 71*d* formed in an upper end thereof in which a pin 75 is engaged, the pin 75 extending from the main body 11 and being positioned just above the pivot 72. Moreover, at a position adjacent the upper side of the main body 11, the longitudinal sides of the cavity 71*d* define the oscillation amplitude of the actuating lever 71 by contact with the pin 75.

Figure 6:
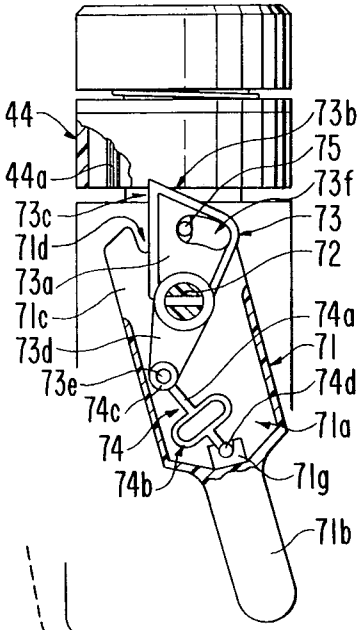
FIGS. 5 and 6 show the reversing device disposed in the two opposed operating positions and in partial views corresponding to that of FIG. 4.
Figure 5:
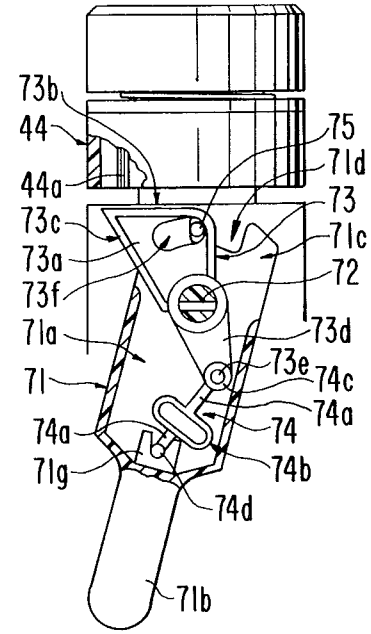

The tooth 73 includes an upper part 73*a* located above the pivot pin 72 and forming the actual stopping tooth for the oscillating arm 4. The upper part 73*a* includes a sidewall 73*b* extending therefrom which is horizontal when the tooth 73 is positioned outside the path of movement of the oscillating arm 4 (as shown in FIG. 5). The upper part 73*a* also includes a sidewall 73*c* which is vertical when the tooth 73 is positioned in the path of movement of the oscillating arm 4 (as shown in FIG. 6). The tooth 73 also includes a lower part 73*d* having a pivot 73*e* at a lower end thereof to which the upper end portion of the resilient connecting rod 74 is hinged.

In addition, a slot 73*f* is formed in the upper part 73*a* in which the pin 75 is received, the slot 73*f* extending arcuately with respect to the pivot 72, a distance sufficient to determine the two essential positions of the stopping tooth 73..

Finally, the resilient connecting rod 74 includes a stem 74*a* on either side of a resilient intermediate part 74*b*, formed by an element having a flattened ring like shape, the stem 74*a* having a bush 74*c* at its upper end portion engaging the pivot 73*e* of the tooth 73, and a pin 74*d* at its lower end portion, the pin 74*d* having opposite ends thereof engaging cavities provided in two spaced apart lateral support elements 71*g* (see also FIG. 2), which are provided in the lever 71.

The sprayer according to the invention operates in a normal and already known manner, as follows. Initially, the oscillating arm 4 is bearing against the flat element 16, due to the effect of the spring 5. Then, during the operation of the water jet coming out from the nozzle 13, the water jet is laterally deflected, initially by the first deflecting fin 43*a*, and then by the second deflecting fin 43*b* which causes it to be additionally deflected, so that it again assumes a direction which is parallel to the starting direction, and as a result thereof it transmits a thrust to the arm 4, which is thereby rotated away from the flat element 16.

If the device for reversing the rotational movement of the arm 4 is disposed as in FIG. 5, with its stopping tooth 73 arranged out of the path of movement of the arm 4, the latter will freely rotate until its deflecting unit is no longer contacted by the water jet, whereupon the arm 4 transmits an impulse to the whole sprayer body and causes the sprayer body to be rotated in the direction of the impact by a short rotational distance.

The cycle as described above is then repeated, over and over until the operating finger 71*b* of the reversing device for reversing the rotational direction comes into contact with one of the tabs 32*a* or 32*b* of the stop elements 3*a* or 3*b*, which then causes the stopping tooth 73 to be moved to the position illustrated in FIG. 6, in which the tooth 73 is disposed within the path of movement of the arm 4.

Figure 7:
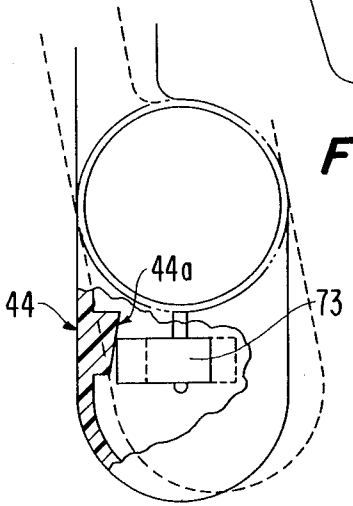
FIG. 7 is a view partially cut along the line IV—IV of FIG. 4, which illustrates the reciprocal interaction between the oscillating arm and the reversing device for reversing the rotation direction.
Figure 4:
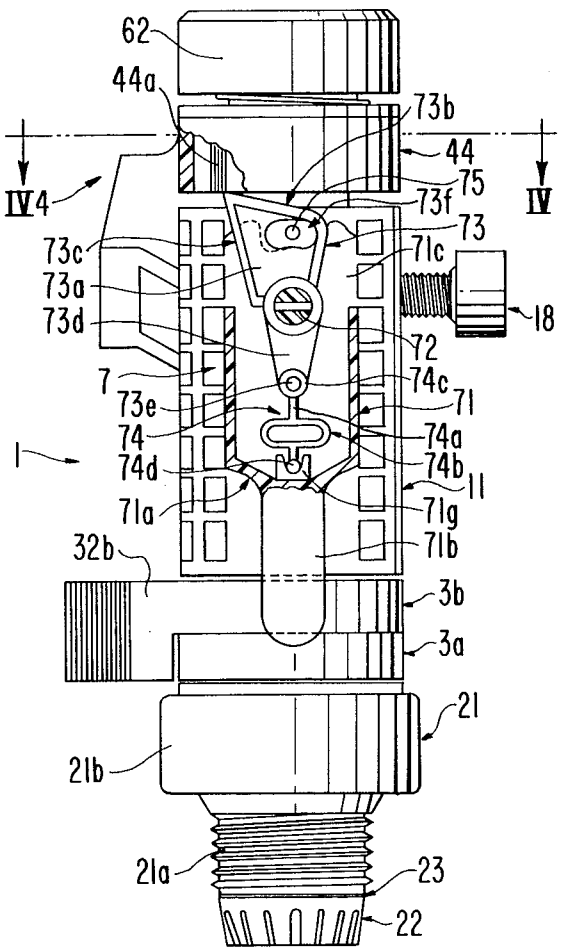
FIG. 4 shows the sprayer of FIG. 1 in a rear and partial cut away view, which particularly illustrates the configuration of the reversing device which is provided for the reversal of the rotation direction thereof.

With the tooth 73 in the position shown in FIG. 6, it follows that the rotation of the arm 4, given a thrust by the water jet as described above, is stopped when it reached the position shown by the dotted lines in FIG. 7, due to the impact of the impact element 44a provided on the auxiliary arm 44 against the stopping tooth 73. As a result, an impulse is given to the tooth 73 which is then transmitted to the sprayer body, and as a consequence thereof the sprayer body is rotated a short rotational distance in a direction which is opposite to the former previously described direction due to impact of the arm 4 with the flat element 16.

It should be noted that the form, the size and the arrangement of the elements constituting the reversing device 7 for reversing the rotation direction and of the corresponding tabs 32a, 32b have been so conceived as to permit the pulsating sprayer according to the invention to accomplish a complete rotation of 360° in the two opposite directions, when the two tabs 32a and 32b are reciprocally adjacent each other.

This is done in order to obtain a spraying distribution which is more regular and uniform compared to that which is obtainable by using the conventional sprayers of the same type, in which, complete rotation is obtained in practice by disengaging the stop elements of the device for reversing the rotation direction, which results in effectively producing a complete rotation thereof but in a single direction only.

In fact, as is already known, the rotation obtained by the impact produced by the return of the oscillating arm against a stopping element which is connected together with the sprayer body, causes a result which is different than with respect to the rotation which is obtained by an impulse derived from the stopping of rotation of the oscillating arm in its first stage in which it is turned away from the water jet direction, and which is produced by an impact against a second stopping element.

In the first case the rotation occurs at a speed and a frequency which are lower with respect to the corresponding ones of the second case, and also the amplitude of the rotation angle of the sprayer at any single impulse is greater, so that it follows that in the first case there is obtained a greater spraying effect with a diffusion thereof which is progressively decreasing toward the central spraying zone, and in the second case a lower spraying effect, which however permits the spraying intensity in the central spraying zone to be increased. Therefore, by passing through the entire rotation angle of 360° in the two opposite directions, there is obtained a considerable improvement of the spraying distribution. It is to be noted that in the most conventional sprayers, a fair regular performance under variable water feeding pressures is obtained by applying, between the sprayer rotating body and the fixing element thereof, several frictional systems which often are too elaborate and complicated, requiring different arrangements of more elements able to produce particular frictional conditions between the two parts.

The sprayer according to the present invention, on the other hand, due to the simple interposition of the sole washer 23 of antifrictional material, permits a regular and uniform operation of the sprayer to be obtained, within a very large range of water feeding pressures, so that it is not necessary to provide additional devices for regulating the return spring of the oscillating arm, of the type which were often used with a few conventional sprayers of this type.

In summary, the main advantages which may be obtained by using the pulsating sprayer according to the present invention are the following:

(a) a very simple and rapid assembling operation, which may be obtained by the system for applying the return spring 5 of the oscillating arm 4, while at the same time obtaining uniform performances of the sprayer, since during this operation a controllable preloading of the spring can be effected thereby permitting a steady value of the same to be obtained;

(b) the ability to vary the height of the water jet, due to the water jet deflector constituted by a sole element, which is easily adjustable and positionable;

(c) the ability to obtain the complete rotation of the sprayer in two opposite directions, by utilizing a reversing device for reversing the sprayer rotational direction, and consequently to have a more uniform and regular spraying distribution with respect to that which may be obtained by rotation of the sprayer in a single direction only;

(d) the provision of an element which combines the functions of two distinct elements, made of different materials; and (e) the provision of a screw for the water jet deflection, which is provided with means for preventing the unthreading operation.

It will be understood by those skilled in the art that while the present invention has been described with reference to the foregoing embodiments, various changes and modifications may be made thereto without departing from the spirit and scope of the appended claims.

I claim:

1. An oscillating sprayer for spraying water on surrounding areas comprising:

a cylindrical main body extending in an axial direction and having a fluid passage therein;

support means for rotatably supporting a lower part of said main body for rotation about a vertical axis and for supplying water from a water supply system to said fluid passage of said main body;

an inclined nozzle extending radially outwardly and upwardly from said main body, said nozzle having a fluid passage therein in fluid communication with said fluid passage of said main body, said nozzle having an opening at a free end thereof in fluid communication with said fluid passage in said nozzle for forming a water stream when water is ejected through said opening;

water stream deflecting means disposed on said main body for deflecting said water stream, said water stream deflecting means being adjustable to intercept said water stream at a plurality of points spaced from said main body;

an oscillating arm rotatably supported on an upper part of said main body, said oscillating arm including water impact means at one end thereof for causing rotation of said oscillating arm in a first direction away from said water stream by intercepting said water stream, said oscillating arm being engageable with said water stream deflecting means when said oscillating arm is rotated in a second direction towards said water stream to thereby cause step-by-step rotation of said main body due to impact of said oscillating arm with said water stream deflecting means;

pivot means disposed on an upper end of said main body for pivoting said oscillating arm about a vertical axis, said pivot means being removable from said upper end of said main body;

spring means disposed between said pivot means and said oscillating arm for biasing said oscillating arm in said second direction about said pivot means towards said water stream so that said oscillating arm impacts said water stream deflecting means and causes said main body to rotate by a small angular rotation about said vertical axis each time said oscillating arm impacts said water stream deflecting means; and reversing means associated with said main body and said oscillating arm for reversing said step-by-step rotation of said main body from said first direction to said second direction, said reversing means including a pair of stopping elements which are movable with respect to each other to adjust a water spraying angle of said sprayer, said stopping elements being positionable to adjust an angle of rotation of said main body about said vertical axis in said first direction and in said second direction, said oscillating arm including a rectilinearly extending member having an impact member at an end thereof opposite to said one end at which said water impact means is disposed, said reversing means including a stopping tooth movably supported on said main body for movement between a first position at which said impact member will impact said stopping tooth when said oscillating arm is rotated in said first direction and a second position at which said stopping tooth will not contact said impact member when said oscillating arm is rotated in said first direction, said reversing means further comprising an actuating lever pivotally mounted about a pivot pin extending from said main body, said stopping tooth pivotally mounted on said pivot pin and a resilient connecting rod pivotally connected at one end thereof to said stopping tooth and at the other end thereof to said actuating lever, said resilient connecting rod being of plastic material and including a resilient portion and a pair of stems, each of which extends in opposite directions away from said resilient portion, said actuating lever including an operating finger engageable with said stopping elements for pivoting said stopping tooth to said first and second positions.

2. The sprayer of claim 1, wherein said stopping tooth comprises a portion through which said pivot pin extends, an upper part extending from said portion and a lower part extending from said portion, said lower part being pivotally connected to said resilient connecting rod and said upper part being engageable with said impact member of said oscillating arm when said stopping tooth is in said first position.

3. The sprayer of claim 2, wherein said upper part of said stopping tooth includes an arcuate slot therethrough, said main body including a guide pin extending therefrom and passing through said arcuate slot in said stopping tooth.

4. The sprayer of claim 3, wherein said actuating lever includes a cavity therein through which said guide pin extends.

5. The sprayer of claim 2, wherein said upper part of said stopping tooth includes a first side and a second side, said first side being horizontal when said stopping tooth is in said second position and said second side being vertical when said stopping tooth is in said first position, said second side being engageable with said impact member of said oscillating arm when said stopping tooth is in said first position.

6. An oscillating sprayer for spraying water on surrounding areas comprising:

a cylindrical main body extending in an axial direction and having a fluid passage therein;

support means for rotatably supporting a lower part of said main body for rotation about a vertical axis and for supplying water from a water supply system to said fluid passage of said main body;

an inclined nozzle extending radially outwardly and upwardly from said main body, said nozzle having a fluid passage therein in fluid communication with said fluid passage of said main body, said nozzle having an opening at a free end thereof in fluid communication with said fluid passage in said nozzle for forming a water stream when water is ejected through said opening;

water stream deflecting means disposed on said main body for deflecting said water stream, said water stream deflecting means being adjustable to intercept said water stream at a plurality of points spaced from said main body, said water stream deflecting means including a support plate extending from said main body, a deflecting element movably supported on said support plate for movement towards and away from said main body to intercept said water stream at said plurality of points and a water stream deflecting screw movably supported on said support plate for movement into and out of said water stream, said support plate comprising a rectangular plate, said deflecting element being flat and having a longitudinally extending groove therein, said groove having inwardly projecting edges and slidably receiving said rectangular plate, said groove further including longitudinal notched portion formed by a plurality of teeth, said rectangular plate including a tooth engageable with said teeth of said notched portion for positioning said flat element with respect to said rectangular plate, said flat element and said rectangular plate further including means for preventing said flat element from sliding off of said rectangular plate;

an oscillating arm rotatably supported on an upper part of said main body, said oscillating arm including water impact means at one end thereof for causing rotation of said oscillating arm in a first direction away from said water stream by intercepting said water stream, said oscillating arm being engageable with said water stream deflecting means when said oscillating arm is rotated in a second direction towards said water stream to thereby cause step-by-step rotation of said main body due to impact of said oscillating arm with said water stream deflecting means;

pivot means disposed on an upper end of said main body for pivoting said oscillating arm about a vertical axis, said pivot means being removable from said upper end of said main body;

spring means disposed between said pivot means and said oscillating arm for biasing said oscillating arm in said second direction about said pivot means towards said water stream so that said oscillating arm impacts said water stream deflecting means and causes said main body to rotate by a small angular rotation about said vertical axis each time said oscillating arm impacts said water stream deflecting means; and reversing means associated with said main body and said oscillating arm for reversing said step-by-step rotation of said main body from said first direction to said second direction, said reversing means including a pair of stopping elements which are movable with respect to each other to adjust a water spraying angle of said sprayer, said stopping elements being positionable to adjust an angle of rotation of said main body about said vertical axis in said first direction and in said second direction.

7. An oscillating sprayer for spraying water on surrounding areas comprising:

a cylindrical main body extending in an axial direction and having a fluid passage therein;

support means for rotatably supporting a lower part of said main body for rotation about a vertical axis and for supplying water from a water supply system to said fluid passage of said main body;

an inclined nozzle extending radially outwardly and upwardly from said main body, said nozzle having a fluid passage therein in fluid communication with said fluid passage of said main body, said nozzle having an opening at a free end thereof in fluid communication with said fluid passage in said nozzle for forming a water stream when water is ejected through said opening;

water stream deflecting means disposed on said main body for deflecting said water stream, said water stream deflecting means being adjustable to intercept said water stream at a plurality of points spaced from said main body, said water stream deflecting means including a support plate extending from said main body, a deflecting element movably supported on said support plate for movement towards and away from said main body to intercept said water stream at said plurality of points to reduce the height of said water stream and a water stream deflecting screw movably supported on said support plate for movement into and out of said water stream, said support plate comprising a rectangular plate, said deflecting element being flat and having a longitudinally extending groove therein, said groove having inwardly projecting edges and slidably receiving said rectangular plate, said groove further including a longitudinal notched portion formed by a plurality of teeth, said rectangular plate including a tooth engageable with said teeth of said notched portion for positioning said flat element with respect to said rectangular plate, said flat element and said rectangular plate further including means for preventing said flat element from sliding off of said rectangular plate;

an oscillating arm rotatably supported on an upper part of said main body, said oscillating arm including water impact means comprising deflecting surfaces at one end thereof for causing rotation of said oscillating arm in a first direction away from said water stream and out of contact with said water stream due to contact of said deflecting surfaces with said water stream, said oscillating arm being engageable with said water stream deflecting means when said oscillating arm is rotated in a second direction towards said water stream to thereby cause step-by-step rotation of said main body due to impact of said oscillating arm with said water stream deflecting means, said oscillating arm further including an engaging part;

pivot means disposed on an upper end of said main body for pivoting said oscillating arm about a vertical axis, said pivot means being removable from said upper end of said main body, said pivot means further including an engaging part;

spring means disposed between said pivot means and said oscillating arm for biasing said oscillating arm in said second direction about said pivot means towards said water stream so that said oscillating arm impacts said water stream deflecting means and causes said main body to rotate by a small angular rotation about said vertical axis each time said oscillating arm impacts said water stream deflecting means, said spring means comprising a helical spring having upper and lower ends extending radially outwardly from the remainder of said helical spring, said upper and lower ends being engageable with said engaging part of said pivot means and said engaging part of said oscillating arm; and reversing means associated with said main body and said oscillating arm for reversing said step-by-step rotation of said main body from said first direction to said second direction, said reversing means including a pair of stopping elements disposed on said support means which are movable with respect to each other to adjust a water spraying angle of said sprayer, said stopping elements being positionable to adjust an angle of rotation of said main body of up to 360° about said vertical axis in said first direction and in said second direction, said reversing means including a stopping tooth movably supported on said main body for movement between a first position at which said oscillating arm will impact said stopping tooth when said oscillating arm is rotated in said first direction and a second position at which said stopping tooth will not contact said oscillating arm when said oscillating arm is rotated in said first direction, said reversing means further comprising an actuating lever pivotally mounted about a pivot pin extending from said main body, said stopping tooth pivotally mounted on said pivot pin and a resilient connecting rod pivotally connected at one end thereof to said stopping tooth and at the other end thereof to said actuating lever, said resilient connecting rod being of plastic material and including a resilient portion and a pair of stems, each of which extends in opposite directions away from said resilient portion, said actuating lever including an operating finger engageable with said stopping elements for pivoting said stopping tooth to said first and second positions; and said pivot means including a tubular body extending in said axial direction, said main body including a hole for receiving said tubular body, said pivot means further including means for preventing rotation of said tubular body with respect to said main body and for adjusting a spring force of said spring by fixing said tubular body at one of a plurality of angular positions with respect to said main body.

8. The sprayer of claim 7, wherein said screw includes resilient means thereon for permitting insertion of said screw in a hole provided in a support arm extending from said support plate and for preventing removal of said screw from said hole.

9. The sprayer of claim 7, wherein said resilient portion of said resilient connecting rod comprises a flattened ring of plastic material.

10. The sprayer of claim 8, wherein said resilient means comprises short inclined fins radially extending from a base of a conical end portion of said screw, said inclined fins having the same angle of inclination as the surface of said conical end portion.

11. The sprayer of claim 10, wherein said support arm includes a support body disposed thereon, said support body having a threaded hole therein threadedly engaged with said screw, said screw having a threaded portion and a non-threaded portion between said threaded portion and said conical end portion, said non-threaded portion being sized to allow said fins to extend therealong when said non-threaded portion is inserted through said threaded hole, said support body including a passage abutting said threaded portion, said passage being sized to allow said fins to move therein without contacting said support body until said fins engage a radially extending wall of said passage connecting said passage to said threaded hole.

* * * * *